US012270321B2

(12) United States Patent
Deokar et al.

(10) Patent No.: US 12,270,321 B2
(45) Date of Patent: Apr. 8, 2025

(54) PIVOTING BRACKET ASSEMBLY, ACTUATOR ASSEMBLY, AND VALVETRAIN

(71) Applicant: Eaton Intelligent Power Limited, Dublin (IE)

(72) Inventors: Vikram Deokar, Pune (IN); Ketaki Purkar, Dhule (IN); Pratik Aher, Pune (IN); Nicola Andrisani, Turin (IT); Emanuele Raimondi, Turin (IT)

(73) Assignee: Eaton Intelligent Power Limited, Dublin (IE)

( * ) Notice: Subject to any disclaimer, the term of this patent is extended or adjusted under 35 U.S.C. 154(b) by 0 days.

(21) Appl. No.: 18/564,703

(22) PCT Filed: May 27, 2022

(86) PCT No.: PCT/EP2022/025251
§ 371 (c)(1),
(2) Date: Nov. 28, 2023

(87) PCT Pub. No.: WO2022/253465
PCT Pub. Date: Dec. 8, 2022

(65) Prior Publication Data

US 2024/0263572 A1 Aug. 8, 2024

(30) Foreign Application Priority Data

May 29, 2021 (IN) ..... 202111024002

(51) Int. Cl.
*F01L 1/18* (2006.01)
*F01L 1/46* (2006.01)
(Continued)

(52) U.S. Cl.
CPC ..... *F01L 1/181* (2013.01); *F01L 1/18* (2013.01); *F01L 1/46* (2013.01);
(Continued)

(58) Field of Classification Search
CPC ..... F01L 1/46; F01L 1/181; F01L 13/0005; F01L 13/06; F01L 2001/186;
(Continued)

(56) References Cited

U.S. PATENT DOCUMENTS 4,605,353 A * 8/1986 Hahn ..... B65G 69/003 16/361
6,325,030 B1 12/2001 Spath et al.
(Continued)

FOREIGN PATENT DOCUMENTS

DE 102018108271 A1 10/2019
DE 102018111710 A1 11/2019
(Continued)

OTHER PUBLICATIONS

International Search Report issued in corresponding application No. PCT/EP2022/025251 dated Nov. 4, 2022, 4 pages.
(Continued)

*Primary Examiner* — Wesley G Harris
(74) *Attorney, Agent, or Firm* — Meunier Carlin & Curfman LLC

(57) ABSTRACT

A pivoting bracket assembly for a valvetrain comprises a pivot pin, a first bracket comprising a first mounting area rotatable about the pivot pin and a first reaction arm extending away from the first mounting area, and a second bracket comprising a second mounting area rotatable about the pivot pin and a second reaction arm extending away from the first mounting area. A compliance member comprises a receiving leg biased against the first bracket and a transfer leg biased against the second bracket. A bias member comprises a first leg biased against the second bracket and a second leg configured to mount the bias member relative to the pivot pin. The bias member is configured to oppose bias forces from the compliance member. An actuator assembly can be
(Continued)

installed so that a rotatable shaft is perpendicular to the pivot pin.

14 Claims, 6 Drawing Sheets

(51) Int. Cl.
*F01L 13/00* (2006.01)
*F01L 13/06* (2006.01)

(52) U.S. Cl.
CPC ..... *F01L 2001/186* (2013.01); *F01L 13/0005* (2013.01); *F01L 2013/001* (2013.01); *F01L 13/06* (2013.01); *F01L 2305/00* (2020.05)

(58) Field of Classification Search
CPC ..... F01L 2013/001; E05F 1/12; E05F 1/1207; E05F 1/1215; E05F 1/1223; E05D 3/04; Y10T 403/599; Y10T 403/602; Y10T 403/60
USPC ..... 16/285, 292, 295, 304, 308, 365
See application file for complete search history.

(56) References Cited

U.S. PATENT DOCUMENTS

| | | | | |
|---|---|---|---|---|
| 6,499,451 | B1 * | 12/2002 | Hendriksma | F01L 1/08 123/90.38 |
| 6,604,498 | B2 | 8/2003 | Fernandez et al. | |
| 7,673,602 | B2 | 3/2010 | Masegi | |
| 8,550,047 | B2 | 10/2013 | Odell et al. | |
| 11,286,817 | B2 | 3/2022 | Radulescu et al. | |
| 2020/0011212 | A1 * | 1/2020 | Biermann | F01L 1/185 |
| 2023/0074370 | A1 * | 3/2023 | Cecchi | F01L 1/20 |

FOREIGN PATENT DOCUMENTS

| | | | | |
|---|---|---|---|---|
| DE | 102018111974 | A1 * | 11/2019 | F01L 1/18 |
| DE | 102018116070 | A1 * | 1/2020 | F01L 1/181 |
| DE | 102018119306 | A1 | 2/2020 | |
| DE | 102018120270 | A1 * | 2/2020 | F01L 1/18 |
| GB | 2205896 | A * | 12/1988 | A47B 1/04 |
| WO | WO-2011024335 | A1 * | 3/2011 | B62K 11/04 |
| WO | WO-2018104872 | A1 * | 6/2018 | F01L 1/18 |
| WO | 2019/170758 | A1 | 9/2019 | |
| WO | WO-2019228670 | A1 * | 12/2019 | F01L 1/18 |
| WO | WO-2020048639 | A1 * | 3/2020 | F01L 1/053 |
| WO | WO-2022040710 | A1 * | 3/2022 | F01L 1/146 |
| WO | WO-2023202802 | A2 * | 10/2023 | F01L 1/185 |

OTHER PUBLICATIONS

Written Opinion issued in corresponding application No. PCT/EP2022/025251 dated Nov. 4, 2022, 5 pages.

* cited by examiner

PIVOTING BRACKET ASSEMBLY, ACTUATOR ASSEMBLY, AND VALVETRAIN

CROSS-REFERENCE TO RELATED APPLICATIONS

This is a National Stage application of PCT international application PCT/EP2022/025251 filed on May 27, 2022, which claims priority to Indian Provisional Patent Application No. 202111024002, filed May 29, 2021, which are incorporated herein by reference in their entireties.

FIELD

This application provides a pivoting bracket assembly installed vertically in a valvetrain. An actuator assembly and latch assembly can have parallel axis with the pivoting bracket assembly extending along a pivot pin perpendicular thereto.

BACKGROUND

Valvetrains are scrutinized for weight, material use, and size. And, it is desired to have variable valve actuation ("VVA"), such as cylinder deactivation, engine braking, early or late valve opening or closing, among combinations thereof. The VVA must also avoid critical shifts.

SUMMARY

The methods and devices disclosed herein overcome the above disadvantages and improves the art by way of a pivoting bracket assembly that can be installed vertically in a valvetrain. Light weight, small size, and compact packaging can be achieved thereby. A latched device, such as a rocker arm, can be loaded by the pivoting bracket assembly so that a latch is moved in an appropriate latching and unlatching window. Instead of splaying actuators across the valvetrain, efficient vertical installations are actuated by an actuator assembly that is installed perpendicular to the pivot pin of the pivoting bracket assembly.

A pivoting bracket assembly for a valvetrain comprises a pivot pin, a first bracket comprising a first mounting area rotatable about the pivot pin and a first reaction arm extending away from the first mounting area, and a second bracket comprising a second mounting area rotatable about the pivot pin and a second reaction arm extending away from the first mounting area. A compliance member comprises a receiving leg biased against the first bracket and a transfer leg biased against the second bracket. A bias member comprises a first leg biased against the second bracket and a second leg configured to mount the bias member relative to the pivot pin. The bias member is configured to oppose bias forces from the compliance member. As an option, the receiving leg can be biased against the first reaction arm and the transfer leg can be biased against the second reaction arm. As an option, the first leg can be biased against the second reaction arm.

A first mounting plate can be on a first end of the pivot pin and a second mounting plate can be on a second end of the pivot pin. The second leg can be mounted against the second mounting plate. The second reaction arm can comprise a positioning tab adjoining the second mounting plate. The first mounting plate can comprise a first mounting location that adjoins to a second mounting location of the second mounting plate.

The pivot pin can comprise diameter changes. A bushing can be seated on the pivot pin, the bushing abutting the compliance member. The bushing can surround a portion of the pivot pin, and the second bracket can be mounted to the bushing.

The bias member can be a torsion spring coiled around the bushing. The compliance member can also be a torsion spring coiled around the pivot pin.

An actuator assembly can comprise the pivoting bracket assembly. The actuator assembly can comprise a rotatable shaft perpendicular to the pivot pin and a cam lobe mounted to the rotatable shaft. The cam lobe can be configured to rotate against the first reaction arm. A controller can be configured to rotate the rotatable shaft.

A valvetrain can comprising the actuator assembly and the pivoting bracket assembly. The valvetrain can comprise a latched device. The latched device can comprising a latch pin projecting towards the second reaction arm. The second reaction arm can be configured to actuate the latched device according to a cam profile of the cam lobe when the rotatable shaft is rotated.

The latch pin can actuate in an axial direction that is parallel to a major axis of the rotatable shaft. The latched device can be a rocker arm rotatable around a rocker shaft. The rocker shaft can be parallel to the rotatable shaft.

Additional objects and advantages will be set forth in part in the description which follows, and in part will be obvious from the description, or may be learned by practice of the disclosure. The objects and advantages will also be realized and attained by means of the elements and combinations particularly pointed out in the appended claims.

DETAILED DESCRIPTION

An actuator assembly 100 can be an electromechanical actuation system ("EMS") and can be used to actuate a latch pin system 50 in a valvetrain component such as a rocker arm 1, 2.

A valvetrain 140 can comprise a latched device. In an unlatched state, the latched device provides one functionality, such as cylinder deactivation, nominal valve lift, or low lift VVA events. In a latched state, the latched device can provide another functionality, such as engine braking, high lift VVA events, among other options. The latched device can be installed in many places in the valvetrain, such as in a tower or carrier or in the cylinder head. Or, a rocker arm 1, 2 can comprise a latch assembly.

Figure 1:
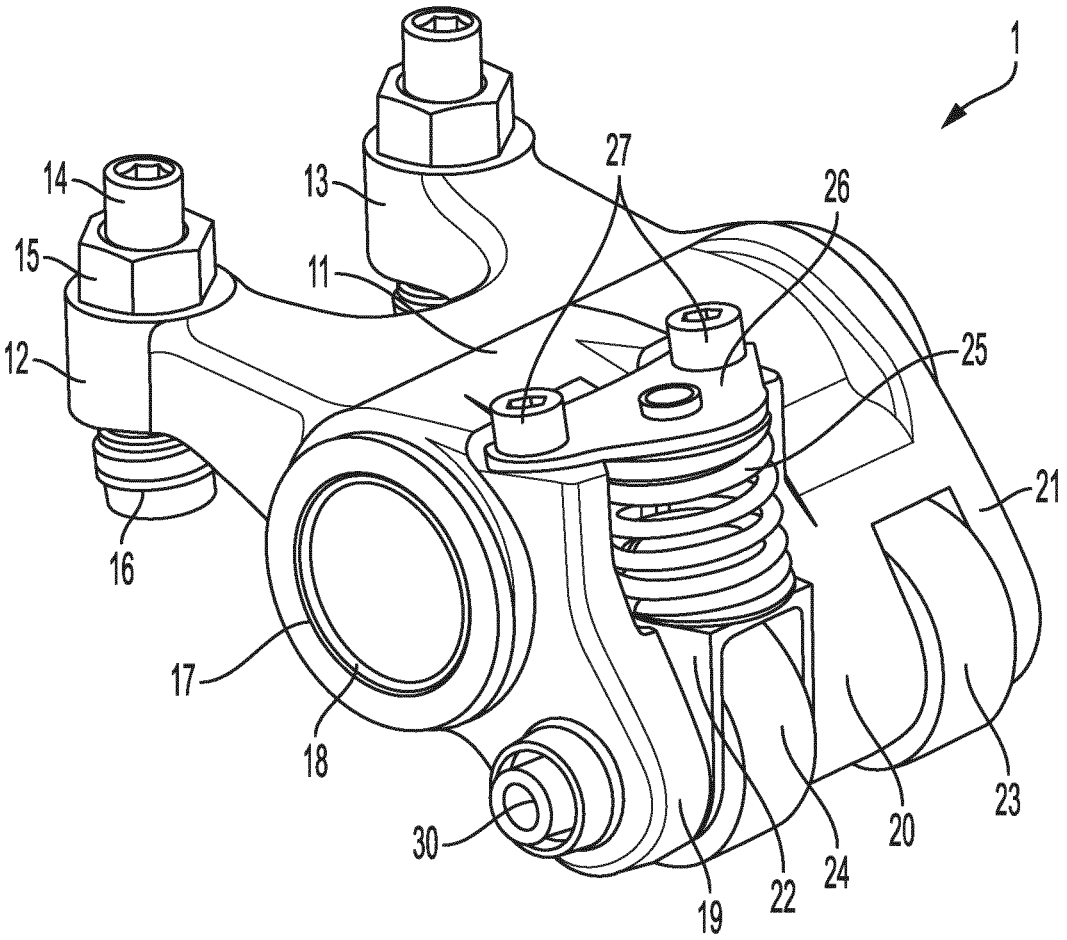
FIG. 1 is a view of an exemplary rocker arm compatible with the teachings herein.

In FIG. 1, an exemplary rocker arm 1 is shown. It comprises dual rollers 23, 24 installed on a cam end body portions 19, 20, 21 of the rocker arm 1. A latch pin 30 projects out of the cam end body portion 19. Rocker arm 1 includes a valve end with two valve arms 12, 13 and features like e-foot 16, lock nut 15, and spigot 14. Rocker arm body 11 includes a rocker shaft bore 17 that can seat a bushing 18. A reaction plate 26 can be mounted by fasteners 27 to secure a lost motion spring 26.

Figure 2A:
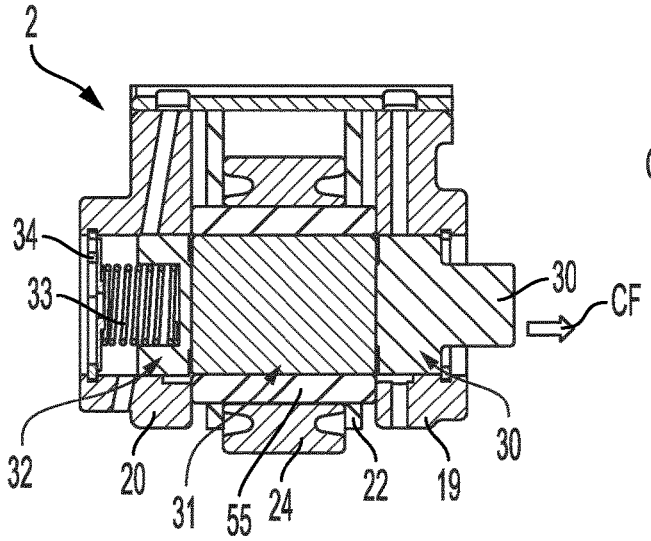
FIGS. 2A-2C are views of a latch assembly comprising a latch pin compatible with the teachings herein.
Figure 2B:
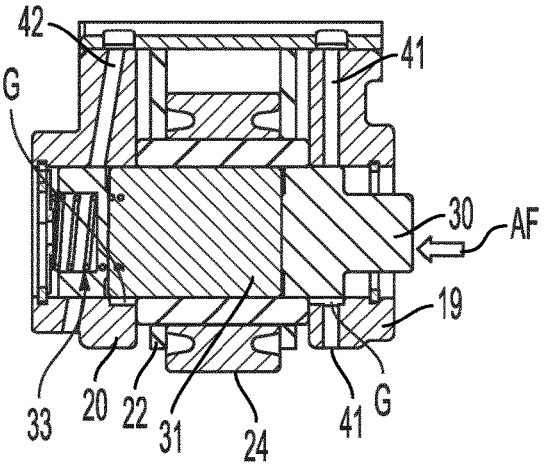
Figure 2C:
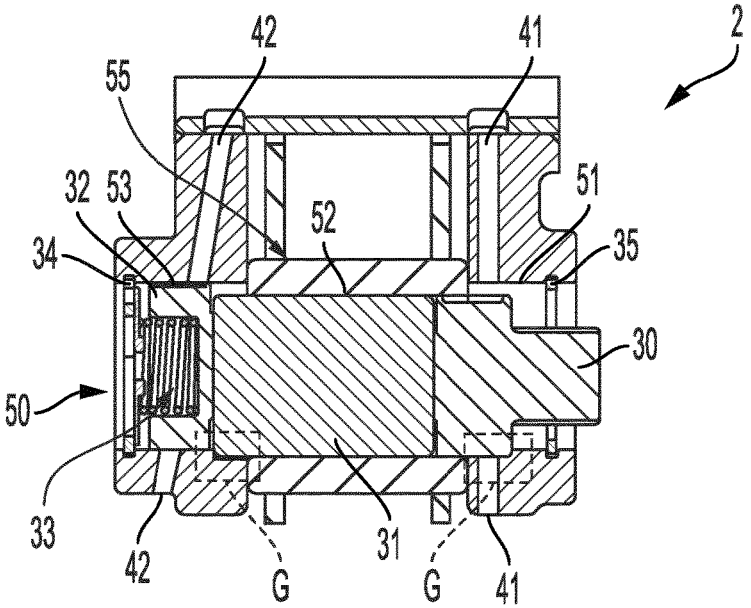
Figure 3:
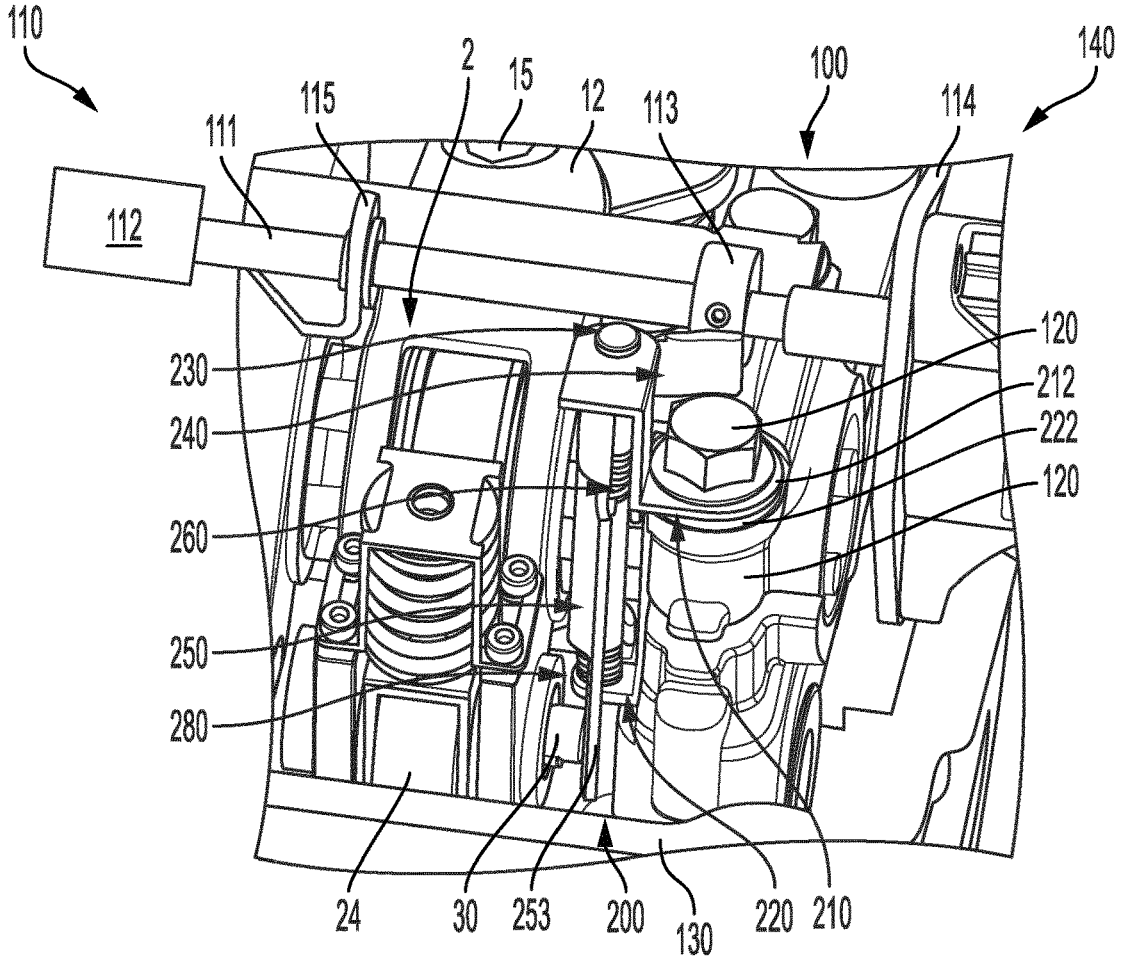
FIG. 3 is a view of a valvetrain comprising an actuator assembly and pivoting bracket assembly relative to an exemplary rocker arm.
Figure 4:
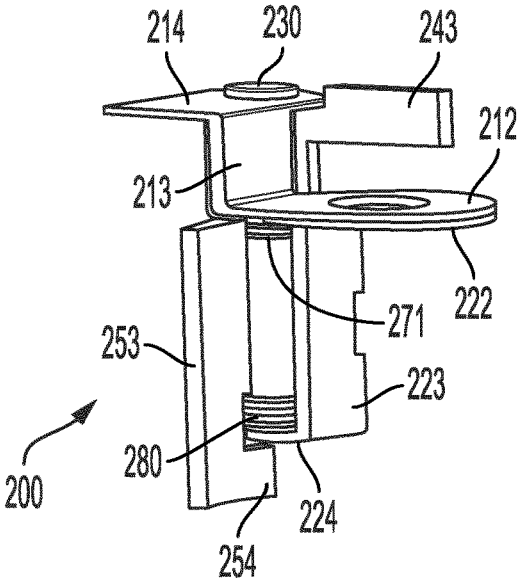
FIG. 4 is a view of a pivoting bracket assembly.

In FIGS. 2A-2C, a rocker arm 2 with a single roller 24 is shown, and its actuation can be applied to the rocker arm 1.

A deactivating technique for roller 24 is shown with a three-pin latch pin system. An electromechanical system, via actuator assembly 100, is arranged to actuate the latch pin system 50. Electromechanical actuation enables low temperature actuation of the latch pin system. Then, the rocker arm 1, 2 or other valvetrain component can implement variable valve actuation (VVA) such as cylinder deactivation (CDA), engine braking (EB), early exhaust valve opening (EEVO), late intake valve closing (LIVC) among many other options to open or close a valve at one or more variable timing (iEGR, NVO, EIVO, LEVC, LIVO, etc.).

Other examples of rocker arms comprising alternative latch pin systems can be found at least in U.S. Pat. Nos. 7,673,602, 8,550,047, 6,604,498, 6,325,030, U.S. Ser. No. 11/286,817, among others. Such latch pin systems can be modified to compatible with the teachings herein.

It can be possible to install a latch pin system in a roller bearing over a cam of a type III center pivot rocker arm system, or in a roller bearing of a type II end pivot rocker arm system, or in the body of the III rocker arm system, such as in the body pieces of the valve end or in the body pieces adjacent the rocker shaft. Or, instead of serving as a bearing axle or as an insert to the bearing axle, the latch pin assembly can be formed within a body portion attached to a slider pad. Then, a switchable roller finger follower, split rocker arm, or switchable rocker arm can be devised.

A working example is shown in FIGS. 2A-2C. A three-pin latch pin system 50 is installed as the bearing axle of a cam side in a type III center pivot rocker arm 2. In the example, the latch pin system 50 is biased to deactivate the inner arm 22 of the rocker arm 2. Outer arms 19, 20 can comprise oil feeds 41, 42 to lubricate or provide oil pressure to latch pin 30 (also called first latch pin) and to third latch pin 32. Inner arm 22 can be latched so as to transfer a lift profile through the roller 24 (FIG. 2C) or inner arm 22 can be unlatched (FIG. 2A) so that the inner arm 22 moves in lost motion. In this working example, the roller 24 comprises an axle 55 with a pin bore 52 in which second latch pin 31 can slide. Outer arms 19, 20 comprise pin bores 51, 53. First latch pin 30 can be travel-limited by a snap ring 35, bushing, or integrally cast or integrally molded or drilled rim or step or like feature. In the working example, first latch pin 30 is stepped so that a portion projects out of the pin bore 51 while another portion is slidable in the pin bore 51. Second latch pin 31 is shown flush to pin bore 52. Third latch pin 32 is configured to slide in pin bore 53. Pin bore 53 can comprise many options but is shown with a snap ring 34 to seat counter spring 33. Snap ring 34 could alternatively be a blind bore feature in outer arm 20 or a cast, molded, or drilled rim or step, or a bushing or plug, among other options. A bleed port or other controlled orifice can be included, and a control logic can be applied to oil feed 42 to provide oil to third latch pin 32. Third latch pin 32 can include a spring cup or other guide feature for counter spring 33. A nipple or one or more nose feature can be included on the face third latch pin 32 and on the face of first latch pin 30 to abut second latch pin 31. Such a nose feature can encourage the first and third latch pins 30, 32 to retract into their respective latch bores 51, 53 when the inner arm 22 moves in lost motion. Nose features, stepped bores, stepped latch pins among other options can be included, for example as taught in commonly owned U.S. Pat. No. 11,286,817.

In the working example, the latch pin system 50 is biased by a counter force CF from counter spring 33 to so that second latch pin 31 is centered between the outer arms 19, 20. Then, cam lift profiles are not transferred through the rocker arm 2 to the valve end. But, when the latch pin system 50 is actuated by an actuation force AF to go from the FIG. 2A position to the FIG. 2B position, the second latch pin 31 travels into the outer arm 20 and the first latch pin 30 travels into the bearing axle 55 so that cam lift profiles transfer through the latched outer arms 19, 20 to the valve end. On base circle of the cam lift profile, the latch pins 30-32 can be aligned co-axial (FIGS. 2A & 2B). A switching window can be manufactured into the cam lift profile to balance force from the valve return spring, the lost motion spring 25, and the cam lobe so that the counter spring 33 in third latch pin 32 can push the second latch pin 31 into the center position or so that the counter spring 33 can be overcome by the force F.

To prevent unwanted travel, gaps G can be formed in the outer arms 19, 20. Then, the inner arm 22 can travel slightly relative to the outer arms 19, 22, but negative roller rotation is not allowed. The inner arm 22 follows the cam lobe but does not over-rotate in response to forces from the lost motion spring 25. First and second latch pin 30 & 31 can travel into gaps G to avoid lost contact with the cam (FIG. 2C). A shoulder can be formed in first latch pin 30 for sure seating in a respective gap G.

To actuate the latch pin system 50, an electromechanical actuator can be installed in the valvetrain 140. A rotary coupling 110 can be formed as one half of an actuator assembly 100. Rotary coupling 110 can be configured to provide actuation forces AF to the second half of the actuator assembly 100, the pivoting bracket assembly 200. Rotary coupling 110 can be installed via mounting brackets 115 or cylinder head or carrier features or tower features 114. Controller 112 can comprise a motor that can convert electrical signals to mechanical rotation of rotatable shaft 111. An onboard computer or electronic control network can be coupled to or co-located with controller 112 for supplying electrical signals to the motor. Numerous alternatives exist in the art. For example, the rotation of rotatable shaft 111 can be via a controller 112 linked to camshaft rotation by a linkage such as a gear chain or a gear drive. While a rotary coupling 110 is disclosed for the working example, other devices such as direct-acting solenoids or linear actuators are not prohibited from being combined with the teachings herein to form one half of actuator assembly 100.

While individual rocker arm control can be had, it is possible to control sets of rocker arms 1, 2 via rotatable shaft 111. The rotatable shaft 111 can be parallel to a major axis of one or more of a rocker shaft, valve lift cam shaft, latch pin system 50, or bearing axle of the rocker arm 1, 2. A tight footprint can be achieved.

Figure 5A:
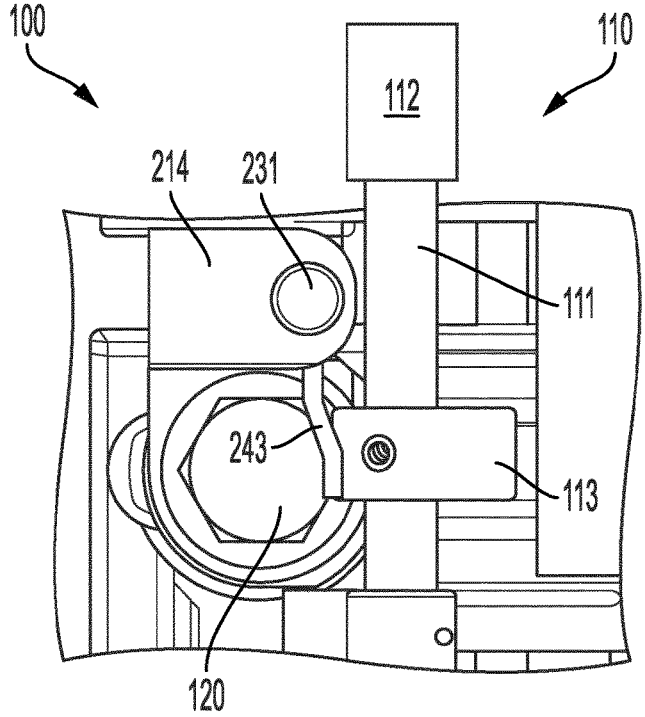
FIGS. 5A-5C are views of the pivoting bracket assembly relative to a latch pin of a latched device and relative to a cam of an actuator assembly.
Figure 5B:
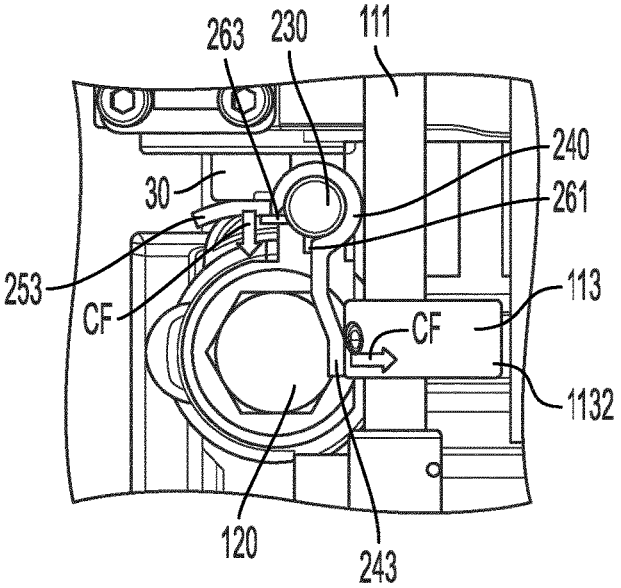
Figure 5C:
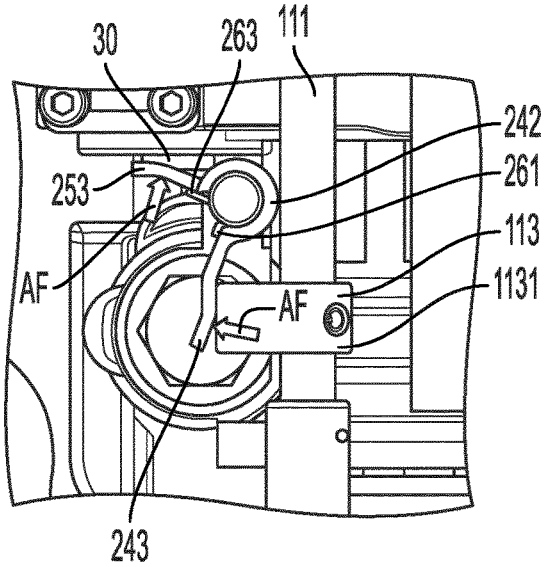
Figure 6:
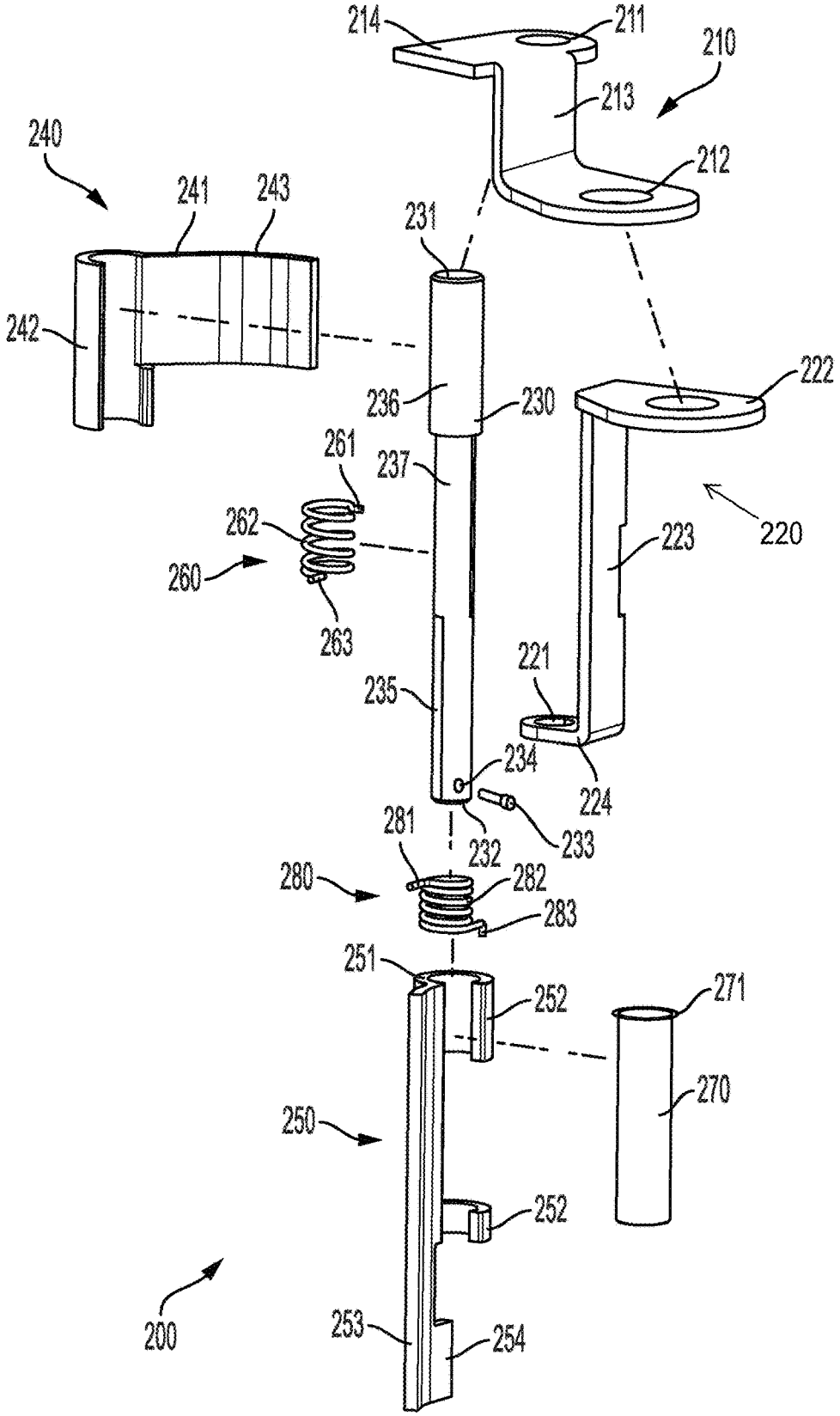
FIG. 6 is an exploded view of a pivoting bracket assembly.
Figure 7A:
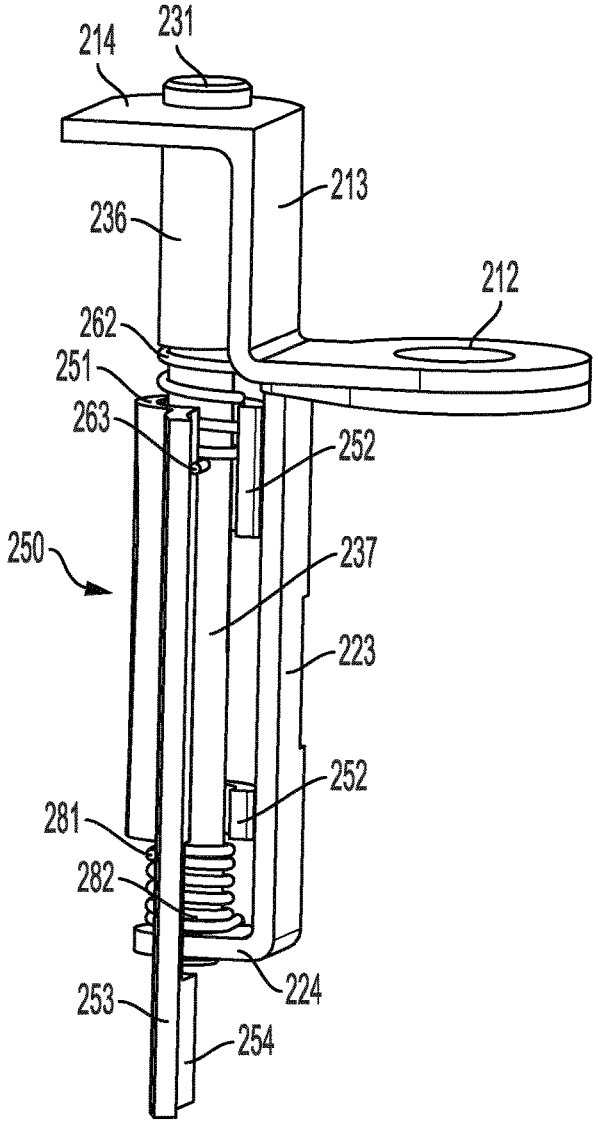
FIGS. 7A & 7B are views showing exemplary pressure points of the compliance member and bias member.
Figure 7B:
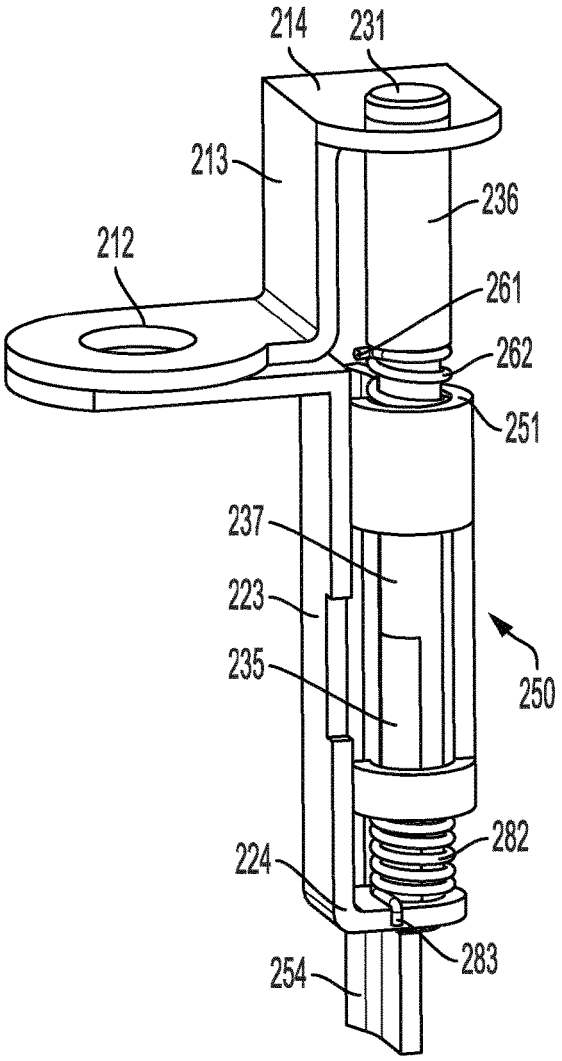

In FIGS. 5A-5C, the rotatable shaft 111 is parallel to the latch pin system 50. The latch pin system motion actuation axis and the rotatable shaft major axis are parallel. This makes for a compact installation. The rotatable shaft 111 can comprise a rotatable linkage such as a cam 113 or spring, many options exist in the art. The working example includes cam 113 having a base circle 1131 and a lift lobe 1132. The rotary motion of the rotatable shaft 111 can be translated into linear motion of the latch pin system 50 by a pivoting backet assembly 200. The pivoting bracket assembly 200 can stand in a valvetrain tower area in a compact arrangement. The latch pin system 50 can move in an axis perpendicular to the major axis of the pivoting bracket assembly 200. The linkages of the pivoting bracket assembly 200 can be positioned anywhere along axial direction of rotatable shaft 111 based on packaging constraints within the engine layout. With the design of the rotary coupling 110, the controller 112 can be mounted outside or inside of the cylinder cover or cylinder block, as needed.

Pivoting bracket assembly 200 can comprise an assembly of linkages to form an actuator that acts in concert with the actuator assembly 100. Pivoting bracket assembly 200 for valvetrain 140 can comprise a pivot pin 230, a first bracket 240, a second bracket 250, a compliance member 260, and a bias member 280.

Pivot pin 230 can be installed vertically in the valvetrain 140. Pivot pin 230 can be adjacent to a rocker arm 1, 2 or other valvetrain component. As shown in FIGS. 3 & 5A-5C, the pivot pin 230 and pivoting bracket assembly 200 fits in a tight space alongside the rocker arm 1, 2. A tower mount 120 and fastener 121 of the cylinder head 130 can be used to secure the pivoting backet assembly 200 in place, and the pivoting bracket assembly 200 fits in the small space between the tower mount 120 and the rocker arm 1, 2. Now, the manifold above the valvetrain can keep a small footprint, as the actuator assembly 100 can be fitted close to the valvetrain components.

Pivot pin 230 can comprise a head 236 and a neck 237. An upper end 231 can abut an upper or first mounting plate 210. A lower end 232 can abut a lower or second mounting plate 220. A hole, indentation, or other seating arrangement can be included in the first and second mounting plates 210, 220 to position the upper and lower ends 231, 232 of the pivot pin 230. Pivot pin 230 can also include an optional positioning groove 235. Additional positioning steps or grooves can be used for purposes such as light weighting or for positioning or guiding the linkages. An optional hitch pin 233 and hitch bore 234 arrangement can be used to lock the pivot pin 230 in the pivoting bracket assembly 200. Hitch pin 233 can take many forms and could alternatively be replaced by a snap ring, bushing, or lock-pin.

A first bracket 240 can comprise a first mounting area 242 rotatable about the pivot pin 230 and a first reaction arm 243 extending away from the first mounting area 242. First bracket body 241 can comprise a stamped, molded, or formed sheet material or flanged tubular structure or a component with a through-hole, as options. In the working example, a sheet material is bent to form the first mounting area 242. Other options can be used, such as through-holes or tubular structures. First reaction arm 243 can be integrated with or one-piece with the body 241 and first mounting area 242. First reaction arm 243 can be sized and shaped per the specifications of the valvetrain 140. First reaction arm 243 can be shaped to bend around components like the fastener 121 or can be shaped to reach towards the cam 113 of the rotary coupling 110. The contact profile of the first reaction arm 243 can be made such that smooth contact is established between the cam 113 and the first bracket 240. First mounting area can wrap around the head 236 of pivot pin 230 as a first positioning diameter of the pivoting bracket assembly 200.

Second bracket 250 can comprise one or more second mounting area 252 rotatable about the pivot pin 230 and a second reaction arm 253 extending away from the second mounting area 252. The contact profile of the second reaction arm 253 can be made such that smooth contact is established between the latch pin 30 and the second bracket 250. Second bracket body 251 can be a stamped, molded, or formed sheet material or flanged tubular structure or a component with a through-hole, as options. In the working example, a light weighted sheet material is bent in two places to form two second mounting areas 252. While second mounting areas 252 can abut pivot pin 230 directly, the working example includes a bushing 270 that slips over a positioning groove 235 of the pivot pin 230 and the second mounting areas 252 abut the bushing 270. The pivot pin 230 can comprise diameter changes. Bushing 270 can be seated on the pivot pin 230, the bushing 270 abutting the compliance member 260. The bushing 270 can surround a portion of the pivot pin 230. The second bracket 250 can optionally be mounted to the bushing 270.

Second reaction arm 253 extends from second bracket body 251. An optional positioning tab 254 can extend from second reaction arm 253. Positioning tab 254 can ride against second mounting plate 220 to assist in stabilizing actuation of pivoting bracket assembly 200, as an example. Or, positioning tab 254 can perform another function, such as being sized or shaped to extend away from pivot pin 230 to push on a latch 30 of latch pin system 50.

A compliance member 260 can comprise a receiving leg 261 biased against the first bracket 240. In the working example, receiving leg 261 is shown biased against first reaction arm 243, though receiving leg 261 could be positioned in a mounting hole or slot or against another surface of first mounting area 242, as options. Receiving leg 261 can be bent or angled to accept actuation forces AF when the first reaction arm 243 is pushed. Compliance member 260 has several installation options, so long as receiving leg 261 receives actuation forces AF from the rotary coupling 110, in this example actuation forces AF from cam 113. Likewise, transfer leg 263 has several options to transfer actuation forces AF to second bracket 250. The working example shows transfer leg 263 biased against the second reaction arm 253, though it too can be bent or angled to push the actuation forces AF to the second bracket 250. The positioning of the compliance spring 260 permits the reverse motion to return the pivoting bracket assembly 200 to the non-actuated position. Counter forces CF from the counter spring 33 can push the latch 30 against the second reaction arm 253. In case of latch pin 30 getting stuck, the compliance member 260 can offer cushioning to manage and absorb cam rotation.

Bias member 280 can also supply counter forces CF. Bias member 280 comprises a first leg 281 biased against the second bracket 250. In the working example, first leg 281 is biased against second reaction arm 253. A second leg 283 can be configured to mount the bias member 280 relative to the pivot pin 230. For example, a hole or slot can accept the second leg 283, or, as drawn, the second leg can flank a portion of the second pin flange 224. The second leg 283 can be mounted against the second mounting plate 220. The bias member 280 can be configured to oppose bias forces from the compliance member 260 so that when the cam 113 is on base circle 1131, the counter forces CF from the counter spring 33 and from the bias member 280 can move the latch pin system 50 to its normally biased position (FIGS. 2A & 5B). But when the cam 113 pushes the lift lobe 1132 against the first reaction arm 243, the counter spring 33 and bias member 280 are overcome and the actuation forces AF actuate the latch 30 projecting from the valvetrain component (FIG. 5C).

The bias member 280 can be a torsion spring coiled around the bushing 270 or around the pivot pin 230. The compliance member 260 can also be a torsion spring coiled around the pivot pin 230. Bushing 270 can be included to provide a guide for the positioning of the compliance member 260, as an example. Bushing 270 can comprise a rolled edge 271 or other lip or rim that secures the placement of compliance member 260 along the major axis of the pivot pin 230. Bushing 270 could also provide support to the second mounting areas 252 or can provide a rotation surface that facilitates smooth turning of parts in the pivoted bracket assembly 200. Cut-outs in one or more of the second reaction arm 253 and second mounting area 242 can form a seat in the second bracket body 241 to position the bias member 280 along the pivot pin 230. While torsion springs are shown for the working example, it can be possible to use leaf springs.

Bias member 260 can be a torsional spring as a linkage to ensure both first and second bracket 240, 250 are loaded against adjacent members (the first bracket 240 is loaded against cam 113 and the second bracket 250 is loaded against latch pin 30).

A first mounting plate 210 can be on first end 231 of the pivot pin 230 and a second mounting plate 220 can be on the second end of the pivot pin 232. The first mounting plate 210 can comprise a first mounting location 212 that adjoins to a second mounting location 222 of the second mounting plate 220. First mounting plate 210 can comprise a first mounting plate body 213 comprising a first pin flange 214 with a first pin seat 211 such as a hole, groove, dimple, among other options. First mounting location 212 can comprise a through-hole for being fastened to the cylinder hear 130 or to a tower mount 120 as designed into the valvetrain 140. Second mounting plate 220 can similarly comprise a second mounting plate body 223 comprising a second pin flange 224 with a second pin seat 221 such as a hole, groove, dimple, among other options. Second mounting location 222 can comprise a through-hole for being fastened to the cylinder hear 130 or to a tower mount 120 as designed into the valvetrain 140. First and second mounting locations 212, 222 can be sandwiched together for simultaneous mounting. Braces, tabs, stays, stakes, among other options can be substituted for the through-holes in the first and second mounting locations 212, 222.

Features of the first and second mounting plates 210, 220 can provide benefits such as additional stability or encasement for the pivoting bracket assembly 200. For example, the second pin flange 224 can stabilize and position the bias member 280. The second leg can be mounted against the second mounting plate. As another example, the second reaction arm 253 can comprise a positioning tab 254 adjoining the second mounting plate 220. The positioning tab 254 could sweep or ride against the second pin flange 224 as a guide or stabilizing aspect.

An actuator assembly 100 can comprise the pivoting bracket assembly 200. The actuator assembly 100 can comprise a rotatable shaft 111 perpendicular to the pivot pin 230 and a cam lobe 113 can be mounted to the rotatable shaft 111. The cam lobe 113 can be configured to rotate against the first reaction arm 240. A controller 112 can be configured to rotate the rotatable shaft 111.

A valvetrain 140 can comprising the actuator assembly 100 and the pivoting bracket assembly 200. The valvetrain 140 can comprise a latched device such as a rocker arm 1, 2. The latched device can comprise a latch pin system 50 with a latch pin 30 projecting towards the second reaction arm 253. The second reaction arm 253 can be configured to actuate the latch pin system 50 according to a cam profile of the cam lobe 113 when the rotatable shaft 111 is rotated.

The latch pin 30 can actuate in an axial direction that is parallel to a major axis of the rotatable shaft 111. The latched device can be a rocker arm 1, 2 rotatable around a rocker shaft 60. The rocker shaft 60 can be parallel to the rotatable shaft 111.

Linkages of the pivoting bracket assembly 200 are compact. Also, the compliance member 260 and bias member 280 can be included to ensure operation of the electromechanical actuator even if another part, such as latch pin 30, sticks in its position or fails to latch or unlatch in its switching window. The compliance member 260 and bias member 280 also permit preloading of the latch pin 30 so that the timing of the rotary coupling 110 can be less than perfect. Then, the cam 113 can load the pivoting bracket assembly 200 and the compliance member 260 can store the actuation forces AF until the latched device is configured to move the latch pin 30. For example, if the rocker arm 1, 2 is still on lift (FIG. 2C), the compliance member can store actuation forces AF until the latch pin system 50 is aligned for actuation (FIG. 2A) and then the compliance member can release the stored actuation forces to move the latch pin system 50 (FIG. 2B). In reverse, the counter spring 33 and bias member 280 can preload with counter forces CF.

The pivoting bracket assembly 200 is able to convert the rotary motion of the cam 113 on the rotatable shaft 111 to axial motion of the latch pin system 50. Once actuator assembly 100 is activated, rotary coupling 110 rotates rotatable shaft 111. This can be, for example, up to 75 degrees or can be a full rotation, as design choices. Then, a cam lobe 113 mounted on rotatable shaft 111 pushes first bracket 240 which pivots on pivot pin 230 and, via the compliance member 260, pushes second bracket 250. Compliance member 260 can be a torsional element between the first and second brackets 240, 250 to ensure both brackets rotate about pivot pin 230 to transfer load/motion to latch pin 30.

Other implementations will be apparent to those skilled in the art from consideration of the specification and practice of the examples disclosed herein.

What is claimed is:

1. A pivoting bracket assembly for a valvetrain, comprising:

a pivot pin;

a first bracket comprising a first mounting area rotatable about the pivot pin and a first reaction arm extending away from the first mounting area;

a second bracket comprising a second mounting area rotatable about the pivot pin and a second reaction arm extending away from the first mounting area;

a compliance member, comprising:

a receiving leg biased against the first bracket; and a transfer leg contacting and biased against the second bracket; and a bias member comprising:

a first leg contacting and biased against the second bracket; and a second leg configured to mount the bias member relative to the pivot pin, wherein an entirety of the bias member is spaced from the first bracket and is configured to oppose bias forces from the compliance member, wherein the pivoting bracket assembly further comprises a first mounting plate on a first end of the pivot pin and a second mounting plate on a second end of the pivot pin, wherein the second leg is mounted against the second mounting plate.

2. The pivoting bracket assembly of claim 1, wherein the pivot pin comprises diameter changes.

3. The pivoting bracket assembly of claim 1, further comprising a bushing seated on the pivot pin, the bushing abutting the compliance member.

4. The pivoting bracket assembly of claim 3, wherein the bushing surrounds a portion of the pivot pin, and wherein the second bracket is mounted to the bushing.

5. The pivoting bracket assembly of claim 3, wherein the bias member is a torsion spring coiled around the bushing.

6. The pivoting bracket assembly of claim 1, wherein the compliance member is a torsion spring coiled around the pivot pin.

7. The pivoting bracket assembly of claim 1, wherein the receiving leg is biased against the first reaction arm, and wherein the transfer leg is biased against the second reaction arm.

8. The pivoting bracket assembly of claim 1, wherein the first leg is biased against the second reaction arm.

9. An actuator assembly comprising:

a pivoting bracket assembly for a valvetrain, comprising:

a pivot pin;

a first bracket comprising a first mounting area rotatable about the pivot pin and a first reaction arm extending away from the first mounting area;

a second bracket comprising a second mounting area rotatable about the pivot pin and a second reaction arm extending away from the first mounting area;

a compliance member, comprising:

a receiving leg biased against the first bracket; and a transfer leg contacting and biased against the second bracket; and a bias member comprising:

a first leg contacting and biased against the second bracket; and a second leg configured to mount the bias member relative to the pivot pin, wherein an entirety of the bias member is spaced from the first bracket and is configured to oppose bias forces from the compliance member:

a rotatable shaft perpendicular to the pivot pin; and a cam lobe mounted to the rotatable shaft, the cam lobe configured to rotate against the first reaction arm.

10. A valvetrain comprising the actuator assembly of claim 9, the valvetrain further comprising a latched device, the latched device comprising a latch pin projecting towards the second reaction arm, the second reaction arm configured to actuate the latched device according to a cam profile of the cam lobe when the rotatable shaft is rotated.

11. The valvetrain of claim 10, wherein the latch pin actuates in an axial direction that is parallel to a major axis of the rotatable shaft.

12. The valvetrain of claim 10, wherein the latched device is a rocker arm rotatable around a rocker shaft, and wherein the rocker shaft is parallel to the rotatable shaft.

13. A pivoting bracket assembly for a valvetrain, comprising:

a pivot pin;

a first bracket comprising a first mounting area rotatable about the pivot pin and a first reaction arm extending away from the first mounting area;

a second bracket comprising a second mounting area rotatable about the pivot pin and a second reaction arm extending away from the first mounting area;

a compliance member, comprising:

a receiving leg biased against the first bracket; and a transfer leg contacting and biased against the second bracket; and a bias member comprising:

a first leg contacting and biased against the second bracket; and a second leg configured to mount the bias member relative to the pivot pin, wherein an entirety of the bias member is spaced from the first bracket and is configured to oppose bias forces from the compliance member, wherein the pivoting bracket assembly further comprises a first mounting plate on a first end of the pivot pin and a second mounting plate on a second end of the pivot pin, wherein the second reaction arm comprises a positioning tab, and wherein the positioning tab adjoins the second mounting plate.

14. A pivoting bracket assembly for a valvetrain, comprising:

a pivot pin;

a first bracket comprising a first mounting area rotatable about the pivot pin and a first reaction arm extending away from the first mounting area;

a second bracket comprising a second mounting area rotatable about the pivot pin and a second reaction arm extending away from the first mounting area;

a compliance member, comprising:

a receiving leg biased against the first bracket; and a transfer leg contacting and biased against the second bracket; and a bias member comprising:

a first leg contacting and biased against the second bracket; and a second leg configured to mount the bias member relative to the pivot pin, wherein an entirety of the bias member is spaced from the first bracket and is configured to oppose bias forces from the compliance member wherein the pivoting bracket assembly further comprises a first mounting plate on a first end of the pivot pin and a second mounting plate on a second end of the pivot pin, wherein the first mounting plate comprises a first mounting location that adjoins to a second mounting location of the second mounting plate.

* * * * *